United States Patent [19]

Saitoh

[11] Patent Number: 4,524,592

[45] Date of Patent: Jun. 25, 1985

[54] COMBINATION LOCK

[75] Inventor: Hisashi Saitoh, Aichi, Japan

[73] Assignee: Saikosha Works Ltd., Kasugai, Japan

[21] Appl. No.: 469,067

[22] Filed: Feb. 23, 1983

[30] Foreign Application Priority Data

Feb. 26, 1982 [JP] Japan ..... 57-27268[U]

[51] Int. Cl.[3] ..... E05B 37/02

[52] U.S. Cl. ..... 70/287; 70/312

[58] Field of Search ..... 70/312, 297, 298, 287, 70/288, 23, 26, 30, 305, 306, 308, 328, 299

[56] References Cited

U.S. PATENT DOCUMENTS

| | | | |
|---|---|---|---|
| 1,345,020 | 6/1920 | Naslund | 70/26 |
| 1,600,050 | 9/1926 | Kessler | 70/312 X |
| 2,121,060 | 6/1938 | Tibbetts | 70/312 |
| 2,160,698 | 5/1939 | Herbst | 70/312 X |
| 4,259,856 | 4/1981 | Wingert | 70/312 X |
| 4,354,365 | 10/1982 | Mayer et al. | 70/30 |

*Primary Examiner*—Gary L. Smith
*Assistant Examiner*—Thomas J. Dubnicka
*Attorney, Agent, or Firm*—Jordan and Hamburg

[57] ABSTRACT

A cylinder type combination lock comprising a housing formed with windows arranged in a row, a corresponding number of disk dials accommodated in the housing for respective rotation therein, each dial having a slit and an operation lever projecting through the concerned window for angularly moving the dials, and a key-like member insertable in the housing, wherein the angular positions of the slits relative to the respective operation lever are formed in such a way that by setting the operation levers in a predetermined arrangement of various angular positions, all slits are put in alignment for unlocking.

12 Claims, 7 Drawing Figures

COMBINATION LOCK

BACKGROUND OF THE INVENTION

1. Field of the Invention

The present invention relates generally to a combination lock formed with a plurality of disk dials to be operated for locking or unlocking.

In general, there are two types of such combination locks. One is of a padlock type having a shackle. The other is of a cylinder type which comprises a first body of a cylindrical configuration formed with a key bore open at one end thereof and connected at the other end thereof with one end of a chain, wire cable or the like loop member, and a second body to be connected with the other end of the loop member and having a key-like projection to be inserted in the first body through the key bore. The present invention relates particulalry to the latter type combination lock.

The invention further relates to a cylinder type combination lock which may allow for a user to select a desired dial combination for unlocking.

2. Description of the Prior Art

Various cylinder type combination locks have been proposed and widely employed for lacking bicycles and the like. For instance U.S. Design Pat. Nos. 231,078, 231,079, 239,079 and 320,711 to the present inventor disclose such types of combination locks. In order to unlock such a conventional lock, the user must angularly move ring dials so as to arrange a series of numerical figures in a line on the peripheral surface of the dials at a predetermined dial setting position. This dial setting operation for unlocking is not only troublesome due to the fact that such conventional combination locks have four or more setting dials for the purpose of increasing the number of possible combinations, but also difficult or impossible in dark places or at night. Therefore, the user is apt to lock his combination lock by turning only one or two ring dials, above all when he is in a hurry, which may result in a possible theft.

The present inventor has proposed in U.S. Pat. No. 4,445,348 issued May 1, 1984, cylinder type combination lock in which the dial combination for unlocking can freely be set or changed by the user. According to such a combination lock, the user may set a desired dial combination, for instance numbers corresponding to his birthday, telephone number, house number or the like so that he will not forget the unlocking dial combination. However, this combination lock is disadvantageous in that it is not suitable to carry out its unlocking operation in dark situations and that the structure is relatively complicated thereby increasing its manufacturing cost.

SUMMARY OF THE INVENTION

Accordingly, a principal object of the present invention is to provide a cylinder type combination lock which can be locked or unlocked without necessity of reading a code on each dial.

Another object of the invention is to provide a cylinder type combination lock which can be locked or unlocked without necessity of reading a code on each dial and which allows the user to select its unlocking dial combination.

A further object of the invention is to provide a cylinder type combination lock which is simple in structure and has a minimum number of structural parts to reduce costs thereof while providing reliability.

The cylinder type combination lock according to the invention comprises a first body of a substantially cylindrical configuration having an elongated hollow chamber therein, a plurality of windows formed in a row along a longitudinal direction and a key bore open at one end thereof, the first member being connected at the other end thereof with one end of a loop member such as chain or wire cable; a plurality of disk dials accommodated in the hollow chamber of the first body and each having an operation level projecting through the respective window; elastic means accommodated in the hollow chamber for urging and stably holding each of the dials to be angularly moved; and a second body connected with the other end of the loop member and having a key-like projection to be inserted into the first body through the key bore open at the free end thereof and by each slit formed in each of the dials.

It is preferable that the first body has an elliptical shape in its cross section and that it is formed with two elongated structural pieces which may be formed by die casting and assembled with use of a suitable securing element such as a fixing pin. In this case, the first and second pieces are adapted to accommodate the dials and elastic means, respectively.

The elastic means may comprise separate leaf springs each pressing a dial in the chamber of the first body to hold the dial in position, but it is preferable that the leaf springs have a common base so as to make setting thereof easy. Each leaf spring has a projection which engages into one of several grooves formed in a peripheral surface of the dial to allow a stepwise click rotation of the latter. The rotational angle of each dial is restricted by the degree of opening of the window formed in the first body, since the operation lever for the dial projects through the window when the combination lock is assembled.

Each dial has a slit for forming the key bore which opens to the free end of the first body, so that the key-like projection of the second body can be inserted in or retracted from the chamber of the second body when the slits formed in each dial align with one another and with the slit formed at the free end of the first body. This state of the combination lock shall be referred to hereinafter as the "unlocking state".

If the key-like projection of the second body is inserted through the key bore in the first body which is kept in the unlocking state and then at least one of the dials is rotated by actuating its operation lever by at least one step, a side wall of the angularly moved dial engages with a concerned tooth of the key-like projection to prevent retraction of the second body from the first one. This state of the combination lock shall be referred to hereinafter as "locking state".

The slit of each dial is formed therein at a certain angle relative to the longitudinal axis of the lever for operating the dial. The angular arrangement of the slit formed in a specified dial determines the position of the dial operation lever within the window which is formed in the first body and through which the operation lever projects. The projection of the concerned leaf spring engages with a specified one of grooves formed in the peripheral surface of the dial to cause the alignment of the dial slit with the key bore opening in the end wall of the first body. In other words, the variety of the angular arrangement of the dial slits for the key bore depends on the number of the grooves formed in the peripheral surface of the dial. If each dial has three peripheral grooves so as to provide three angular positions of the operation lever within the window formed in the first body and each combination lock has four or more of such dials, a manufacturer may provide two or three dials with different slit angular positions and select a specific dial combination for unlocking from a plurality of possible dial combinations. In this case, the user who purchases the combination lock can set the dial combination for unlocking in accordance with information thereof provided on a tag attached to the lock, so that he can easily remember the set combination although it is given not as a numeral code but rather as angular positions of the levers for operating the dials.

The parts for the combination lock according to the invention are less in number and kind. They include a first body which may be of two pieces joined by a securing means such as a fixing pin, a second body which has been previously connected to the first body through the loop member, and a plurality of dials each having an operation lever as well as an elastic means such as a combined leaf spring. Assembly thereof into the lock is quite easy. Therefore, the manufacturer may sell the combination lock in the form of kit therefor so that the user may select one of a large number of possible unlocking dial combinations to assemble his own lock.

BRIEF DESCRIPTION OF THE DRAWINGS

FIG. 3 shows the first body of the combination lock, wherein

DESCRIPTION OF THE PREFERRED EMBODIMENT

Figure 1:
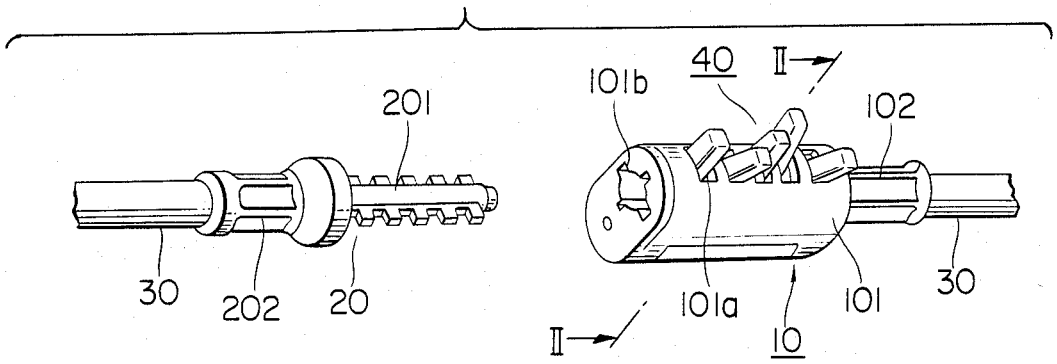
FIG. 1 is a perspective view of a combination lock consisting of first and second bodies according to the present invention, a loop member secured thereto being shown partly cut off.

Referring to the drawings and more particularly to FIG. 1, a cylinder type combination lock according to the present invention comprises mainly a first body 10 and a second body 20. The first body 10 comprises a hollow cylindrical housing 101 formed with a plurality of windows 101*a* in a row along a longitudinal direction thereof and a slit 101*b* forming a key bore in one end wall thereof, and a head 102 fixed integrally with the other end wall of the housing 101, the head being connected with one end of a loop member 30 such as a wire cable, chain or the like. The second body 20 has a key-like portion 201 and a head portion 202 integrally fixed with each other, the latter being connected with the other end of the loop member 30 so that when the key portion 201 is inserted in the first body through the slit 101*b* for locking, the closed loop is formed. Members generally designated by reference numeral 40 in FIG. 1 are operation levers each being integrally attached on the peripheral surface of a dial accommodated in the housing 101 of the first body 10. In the illustrated embodiment, the combination lock has five dial operation levers 40. The number of the levers and consequently of dials may be varied, but it is preferable to select four to six in since a larger number increases the number of possible dial combinations so as to more effectively prevent theft but makes the setting thereof into its specific dial combination troublesome. Even if six is selected it will be appreciated that the locking and unlocking operation by the actuating levers is far easier than angularly moving for instance four ring dials each having numerical figures 0–9 around the surface to form a predetermined four numerical figures arrangement.

Figure 2:
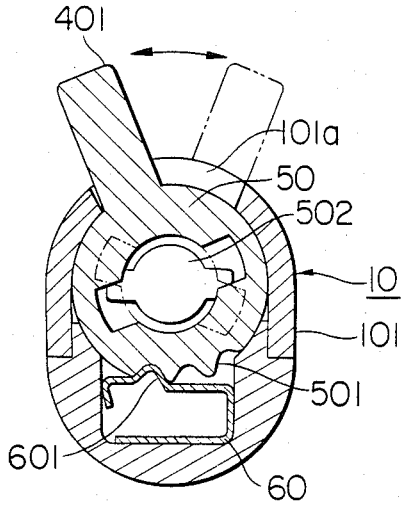
FIG. 2 is an enlarged sectional view taken along line II—II in FIG. 1.

As shown in FIG. 2, each disk dial 50 fixed with lever 401 is accommodated in the housing 101 of the first body 10 so that the lever 401 projects through the concerned window 101*a*. The dial 50 has a plurality of grooves 501 formed in its peripheral surface and a central slit 502 for the key bore. The dial 50 is urged in the housing 101 by an elastic means such as a leaf spring 60 having a projection 601 so as to engage with any of the grooves 501, whereby operation of the lever 401 causes a stepwise click rotation of the dial 50 in the housing. Due to the rotation of the dial 50, the central slit 502 formed in the dial 50 changes in its angular position to cause an alignment or non-alignment thereof to one another and with the key bore (FIG. 1) open at the free end of the housing 101, which correspond to an "unlocking position" and "locking position", respectively.

In the illustrated embodiment, each of the dials 50 has three peripheral grooves 501 and thus the operation lever 401 can take one of the three angular positions within the window 101*a*. Two of such positions are shown in FIG. 2 in solid and broken lines, respectively, but the number of the angular positions for the lever 401 may be increased or decreased.

Figure 3A:
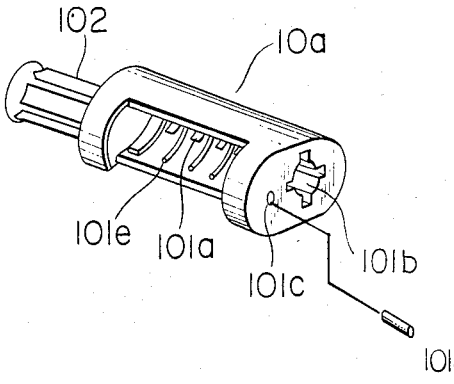
FIGS. 3(A) and 3(B) are perspective views showing an inner part of a first and second pieces.
Figure 3B:
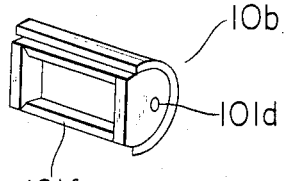

As shown in FIG. 3, the first body 10 may be made from two separate elongated structure pieces, namely a first or main piece 10*a* accommodating mainly the dials 50 and a second or lid like piece 10*b* accommodating mainly leaf springs 60. The first and second pieces may integratedly be assembled by securing means such as a fixing pin 101*g* to be inserted through a through-hole 101*c* formed in each end wall of the first piece 10*a* and in a blind-hole 101*d* formed in each end wall of the second piece 10*b*. Owing to such construction, the two pieces may be formed according by die casting at a low cost and the dials 50 and elastic means may readily be assembled in the housing 101. It is preferable that the first piece 10*a* has a plurality of libs 101*e* on inner surface thereof to stably accommodate each dial 50 between neighboring two libs and that the second piece 10*b* has shoulders 101*f* with a curved surface which serve as a seat for each of the dials 50.

Figure 4:
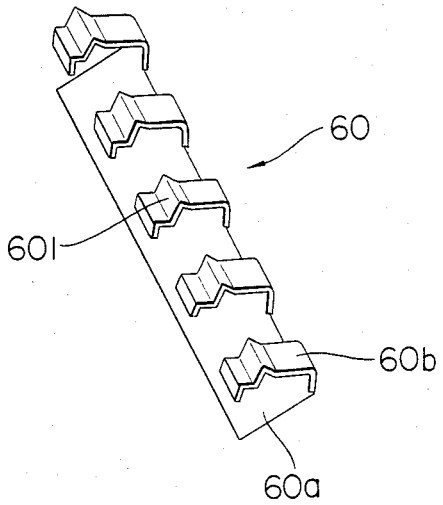
FIG. 4 is an enlarged perspective view showing an elastic means.
Figure 5:
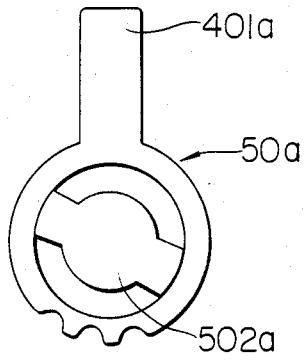
FIGS. 5(A) and 5(B) are front views of dials which may be employed in the combination lock.
Figure 5:
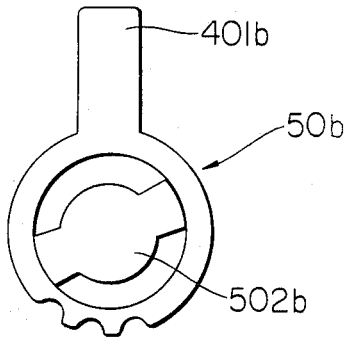

The leaf springs 60 accommodated in the second piece 10*b* may consist of individual springs for each dial 50, but it is preferable to manufacture the springs with a common base plate as shown in FIG. 4. The elastic means shown in FIG. 4 comprises a common base 60*a* of a metallic material with each leaf spring 60*b* being formed integrally with the base 60*a*. Such an elastic means is preferable in that the entire elastic means with a plurality of leaf springs can be manufactured through a single stamping operation of a metallic material sheet and a bending operation common to the leaf springs to be formed. Also it is quite easy to assemble the elastic means into the second piece.

In FIGS. 5(A) and 5(B), there are shown dials 50*a* and 50*b* which are different from the dial 50 as shown in FIG. 2 in that in FIG. 2 the central slit 502 forming the key bore is extended perpendicular to the axis of the dial operation lever 401. On the other hand, each of the dials 50*a* and 50*b* in FIGS. 5(A) and 5(B) has, respectively, a central slit 502*a* (502*b*) arranged not at a right angle to the longitudinal axis of the dial operation lever 401*a* (401*b*), but rather slanted at some other angle. If all of the dials for each combination lock were the same, there would be only one common unlocking dial combination for the lock and thus such lock could not be a "combination lock". Therefore, the dials each formed with the central slit in various angular arrangements relative to the axis of its operation lever, namely the dials 50, 50*a* and 50*b* should be provided and those are employed in combination for each combination lock having an inherent unlocking dial combination selected from a large number of possible combinations.

In the illustrated embodiment, the dials are selected from three kinds, namely dials 50, 50*a* and 50*b* but it is to be noted that a number of the dial kinds may be increased or decreased depending on the number of grooves to be formed in the peripheral surface of the dial.

The invention will now be further explained as to how to set a desired unlocking dial combination and assemble the combination lock.

The manufacturer or user inserts the leaf spring assembly 60 in the second piece 10*b* 10 so that the base 60*a* of the assembly 60 is disposed on a flat bottom in the second piece 10*b*. In the case of the illustrated combination lock with five dials to be selected from three kinds of dials (50, 50*a* and 50*b*), he then selects five dials among the three kinds to provide a desired dial operation lever arrangement for unlocking and inserts them in the first piece 10*a* to attain the lever arrangement, wherein all key slits (502, 502*a* and 502*b*) of the dials aligns with one another and with the slit 101*b* for the key bore at the end wall of the first piece 10*a* or housing 101. Thereafter, he applies the second piece 10*b* accommodating the leaf spring assembly 60 on the first piece 10*a* accommodating the dials in order and inserts the fixing pin or the like element in the holes 101*c* and 101*d* to fit the same therein to assemble the combination lock. This combination lock is now in the unlocking state to allow insertion of the second body 20 having key-like projection 201 as shown in FIG. 1 into the first body 10 through the key bore 101*b* opening in the end wall of the first body 10 and formed by the slits in the dials. If at least one of the dial operation levers 401, 401*a* and 401*b* is actuated to cause angular movement of the concerned dial when the key-like projection 201 of the second body 20 has been fully inserted in the first body 10, such rotation of the dial causes non-alignment of its slits 502, 502*a*, or 502*b* with the slit 101*b* formed in the end wall of the first body 20 to prevent withdrawal of the second body 20 from the first body 10, namely the combination lock is then in its locking state.

According to the combination lock of the invention, the specific or inherent unlocking dial combination thereof can be memorized not as numeral figures or the like code but as a positional combination of the dial operation levers and thus the user may operate his combination lock for locking or unlocking, even in a darkened situation without relying on a code as is conventionally used dials but depending on feeling with his finger.

What is claimed is:

1. A combination lock comprising an elongated housing having an inner chamber, a plurality of windows arranged in a row along the longitudinal length of said housing, one longitudinal end of said housing having a key opening, said housing having an inner portion defining at least a partial internal cylindrical surface, a plurality of dials each having at least a partial outer cylindrical surface, said dials being rotatably supported in said housing by the mating and engagement of said internal and outer cylindrical surfaces, each of said dials having a lever extending through said windows to provide for manual rotation of said dials, each of said dials having a plurality of grooves, elastic means disposed in said housing and operable to engage said grooves, each of said dials having an inner bore and a slot, said dials being rotatable to an unlocked position in which said slots are axially aligned, said dials being rotatable to a locked position in which said slots are non-axially aligned, and key means inserted through said key opening into said inner bore of said dials, said key means having projections slidable in said axially aligned slots when said dials are in said unlocked position, said dials engaging said projections to preclude axial withdrawal of said key means when said dials are in said locked position, whereby the number of parts are minimized in that the dials which engage said key means to effect locking and unlocking are rotatably supported by said internal cylindrical surface of said housing.

2. A combination lock according to claim 1, wherein said housing comprises a first housing part and a second housing part, means for joining said two housing parts, said first housing part having a first housing surface constituting at least a portion of said internal cylindrical surface, said first housing part having an opening leading to said first housing surface to permit said dials to be assembled in their rotatably mounted position in said first housing part prior to assembly of said first and second housing parts.

3. A combination lock according to claim 2, wherein said first housing surface defines a partial cylindrical surface which does not exceed 180 degrees.

4. A combination lock according to claim 2, wherein said first housing surface defines a 180 degree cylindrical surface.

5. A combination lock according to claim 2, wherein said first housing part has a generally U-shaped cross-sectional configuration.

6. A combination lock according to claim 2, wherein said elastic means is mounted in said second housing part.

7. A combination lock according to claim 2, wherein said second housing part has at least a second housing surface constituting at least a portion of said internal cylindrical surface such that said dials are rotatably supported by said first housing surface and said second housing surface.

8. A combination lock according to claim 1, wherein the slot of each dial extends generally radially from the respective inner bore of each slot, the lever of each dial extending generally radially outwardly from the respective dial, the angle between the slot and lever of one dial being different from the angle between the slot and lever of at least one other dial such that said levers are non-axially aligned when said slots are axially aligned.

9. A combination lock according to claim 1, wherein said housing has an inner portion defining a channel, said elastic means being disposed in said channel.

10. A combination lock according to claim 1, wherein said elastic means comprises a plurality of leaf springs integrally joined to a common support, each of said leaf springs having a projection engaging one of said grooves in said dials.

11. A combination lock according to claim 1, wherein said housing has a plurality of libs on said internal cylindrical surface providing spacers for said dials.

12. A combination lock comprising a housing having an inner chamber, window means arranged in said housing, said housing having an end wall, a key opening in said end wall, said housing having an inner portion defining at least a partial internal cylindrical surface, a plurality of dials each having at least a partial outer cylindrical surface, said dials being rotatably supported in said housing by the mating and engagement of said internal and outer cylindrical surfaces, said dials having outer levers extending through said window means to provide for manual rotation of said dials, said dials each having an inner bore with a slot, said dials being rotatable to an unlocked position in which said slots are axially aligned, said dials being rotatable to a locked position in which said slots are non-axially aligned, and key means inserted through said key opening into said inner bore of said dials, said key means having projections slidable in said axially aligned slots when said dials are in said unlocked position, said dials engaging said projections to preclude axial withdrawal of said key means when said dials are in said locked position, whereby the number of parts are minimized in that the dials which engage said key means to effect locking and unlocking are rotatably supported by said internal cylindrical surface of said housing.

* * * * *